US009353334B2

(12) United States Patent
Isobe et al.

(10) Patent No.: US 9,353,334 B2
(45) Date of Patent: May 31, 2016

(54) METHOD FOR CLEANING MEDICAL INSTRUMENT

(75) Inventors: Kazuo Isobe, Wakayama (JP); Masaya Nishio, Wakayama (JP); Tatsuya Sakai, Wakayama (JP)

(73) Assignee: KAO CORPORATION, Tokyo (JP)

( * ) Notice: Subject to any disclaimer, the term of this patent is extended or adjusted under 35 U.S.C. 154(b) by 157 days.

(21) Appl. No.: 13/976,815

(22) PCT Filed: Dec. 28, 2010

(86) PCT No.: PCT/JP2010/073734

§ 371 (c)(1), (2), (4) Date: Jun. 27, 2013

(87) PCT Pub. No.: WO2012/090306

PCT Pub. Date: Jul. 5, 2012

(65) Prior Publication Data

US 2013/0296213 A1 Nov. 7, 2013

(51) Int. Cl.

| | |
|---|---|
| ***C11D 9/20*** | (2006.01) |
| ***C11D 3/20*** | (2006.01) |
| ***C11D 3/386*** | (2006.01) |
| ***C11D 3/37*** | (2006.01) |
| ***C11D 3/30*** | (2006.01) |
| ***C11D 11/00*** | (2006.01) |

(52) U.S. Cl.

CPC ..... *C11D 3/30* (2013.01); *C11D 3/2065* (2013.01); *C11D 3/38618* (2013.01); *C11D 11/0041* (2013.01)

(58) Field of Classification Search

USPC ..... 510/161, 226, 356, 497, 499

See application file for complete search history.

(56) References Cited

U.S. PATENT DOCUMENTS

| | | | |
|---|---|---|---|
| 5,810,944 | A | 9/1998 | Smitkowski et al. |
| H1776 | H | 1/1999 | Linard et al. |
| 2004/0002432 | A1 | 1/2004 | Okuda et al. |
| 2004/0203129 | A1 | 10/2004 | Hatada et al. |
| 2005/0026804 | A1 | 2/2005 | Sato et al. |
| 2006/0194706 | A1 | 8/2006 | Tijanic et al. |
| 2010/0184188 | A1 | 7/2010 | Okuda |

FOREIGN PATENT DOCUMENTS

| | | | |
|---|---|---|---|
| EP | 0 348 183 | A2 | 12/1989 |
| JP | 2-45599 | A | 2/1990 |
| JP | 9-512586 | A | 12/1997 |
| JP | 11-222687 | A | 8/1999 |
| JP | 2001-31999 | A | 2/2001 |
| JP | 2001-164298 | A | 6/2001 |
| JP | 2001-271097 | A | 10/2001 |
| JP | 2002-53895 | A | 2/2002 |
| JP | 2004-122 | A | 1/2004 |
| JP | 2004-57195 | A | 2/2004 |
| JP | 2004-305175 | A | 11/2004 |
| JP | 2006-219552 | A | 8/2006 |
| JP | 2007-23268 | A | 2/2007 |
| JP | 2007-61101 | A | 3/2007 |
| JP | 2008-133340 | A | 6/2008 |
| JP | 2008-184500 | A | 8/2008 |
| JP | 2008-530279 | A | 8/2008 |
| JP | 2008-212084 | A | 9/2008 |
| JP | 2009-34062 | A | 2/2009 |
| JP | 2009-41078 | A | 2/2009 |
| JP | 2009-144070 | A | 7/2009 |
| JP | 2009-155615 | A | 7/2009 |
| JP | 2010-229387 | A | 10/2010 |
| JP | 2011-12219 | A | 1/2011 |
| JP | 2012-140483 | A | 7/2012 |
| JP | 2012-140484 | A | 7/2012 |
| JP | 2012-140485 | A | 7/2012 |
| WO | 2009/020546 | A1 | 2/2009 |

OTHER PUBLICATIONS

Chinese Office Action dated Jul. 2, 2014 for Chinese Application No. 201080070795.3 with English translation.

International Preliminary Report on Patentability and Written Opinion of the International Searching Authority, dated Jul. 2, 2013, for International Application No. PCT/JP2010/073734.

Machine generated English translation of JP-2001-31999-A dated Feb. 6, 2001.

Machine generated English translation of JP-2009-144070-A dated Jul. 2, 2009.

Machine generated English translation of JP-2011-12219-A dated Jan. 20, 2011.

International Search Report issued in PCT/JP2010/073734, dated Mar. 29, 2011.

*Primary Examiner* — Ling Choi
*Assistant Examiner* — Thuy-Ai Nguyen
(74) *Attorney, Agent, or Firm* — Birch, Stewart, Kolasch & Birch, LLP

(57) ABSTRACT

The present invention discloses the method for cleaning a medical instrument using a treatment liquid, wherein the treatment liquid contains:

(A) an alkanolamine in an amount of 0.004 to 1% by mass, (B) a nonionic surfactant in an amount of 0.002 to 1% by mass, (C) a polyhydric alcohol in an amount of 0.004 to 10% by mass, (D) an alkaline protease in an effective amount, and (E) water, and has a pH of not lower than 9.

15 Claims, No Drawings

METHOD FOR CLEANING MEDICAL INSTRUMENT

FIELD OF THE INVENTION

The present invention relates to a method for cleaning a medical instrument, that is highly effective for cleaning, well adapted to cleaning with a medical instrument washer, and effective for protection of metal part of the medical instrument from corrosion.

BACKGROUND OF THE INVENTION

After use in examination, therapy, and surgery, steel medical instruments such as scissors, forceps, and tweezers and hard and soft endoscopes are dirty with blood or body fluid or the like. Due to a possible contamination of the dirt with a pathogenic protein, such as abnormal prion, bacterium, or virus, such a dirty medical instrument should be certainly cleaned, sanitized, and sterilized to be reused. It is said that, in cleaning of a medical instrument, sanitization and/or sterilization are less effective by insufficient washing and remaining dirt than expected, resulting in imperfect sanitization and/or sterilization. In addition, a remaining protein after a step of cleaning is denatured with a sanitizer such as glutaraldehyde or peracetic acid or a disinfecting treatment with high-pressure steam or ethylene oxide in a next step to become stubborn dirt that is very strong and hard to be removed.

In clinical practice, a cleaning result of a medical instrument with these cleaning agents is generally visually examined. A medical instrument still having visible dirt will be cleaned again. However, a recent study reported that most of medical instruments used in clinical practice had no visible dirt by being cleaned with a commercial neutral enzyme detergent or an alkaline detergent, but these were then fluorescently-stained and thoroughly examined with a fluorescent microscope, there was still protein dirt fixed on these instruments (Journal of Hospital Infection (2008) 68, 52-58).

Neutral and weak alkaline dilutions of neutral enzyme detergents have been conventionally used as a medical instrument cleaning liquid that can remove protein dirt.

JP-A2001-31999 describes a method of cleaning with a neutral or weak alkaline enzyme detergent. The method of JP-A2001-31999 unfortunately has a problem of conflicting effects of an alkanolamine that is necessary for achieving a sufficient detergency but causes corrosion of light metals such as aluminum. Very expensive medical instruments like as an endoscope should never be corroded by cleaning.

JP-A02-45599 and JP-WO9-512586 each disclose a cleaning liquid containing an ionic surfactant together with a nonionic surfactant, an alkanolamine, and a protease. The addition of the ionic surfactant, in one hand, provides a relatively high detergency, but on the other hand, problematically causes heavy foaming during cleaning in a medical instrument washer and much foam overflows a cleaning tank or decrease the propagation of a physical force, such as of water stream and ultrasonic wave, to the medical instrument to result in a decreased detergency to an insufficient level. A reduced amount of the ionic surfactant results in a reduced amount of foam but also a reduced detergency to an insufficient level. To enhance the detergency of a cleaning liquid of such a formulation, the alkalinity of the cleaning liquid may be increased, but an increased alkalinity causes a problem of corrosion of light metals.

JP-W2008-530279 discloses a detergent composition containing a detergent for medical instruments and an anti-corrosive substance. But the cleaning method of the publication has an insufficient detergency to fixed blood stains and besides has a difficulty in perfect prevention of generation of a residual metal salt derived from the anti-corrosive substance. The detergent composition of the patent is therefore hardly applicable to cleaning of a medical instrument that is inserted in the body and required to rigorously ensure the safety thereof.

JP-A2008-133340 discloses a liquid detergent composition used in an automatic dishwasher, that contains a water-soluble solvent selected from glycerol, ethylene glycol, and propylene glycol, an enzyme, a water-soluble calcium salt, an alkanolamine compound, and water.

SUMMARY OF THE INVENTION

The present invention relates to a method for cleaning a medical instrument, using a treatment liquid, wherein the treatment liquid contains:

(A) an alkanolamine in an amount of 0.004 to 1% by mass, (B) a nonionic surfactant in an amount of 0.002 to 1% by mass, (C) a polyhydric alcohol in an amount of 0.004 to 10% by mass, (D) an alkaline protease in an effective amount, and (E) water, and has a pH of not lower than 9.

The method of the present invention includes contacting the treatment liquid with a medical instrument.

DETAILED DESCRIPTION OF THE INVENTION

As described in Background of the invention, in the sense of washing off body fluid or blood, there is no method for cleaning a medical instrument that is highly effective enough for removing fixed protein dirt and is effective for protection of metal part of the medical instrument from corrosion.

The present invention relates to a method for cleaning a medical instrument that is effective for removing a protein or the like, well adapted to cleaning with a medical instrument washer, and suppresses metal part of the medical instrument from corroding.

The present inventors have intensively investigated to achieve the purpose, and accomplished the present invention.

According to the present invention, provided is a method for cleaning a medical instrument that is effective for removing a protein or the like, well adapted to cleaning with a medical instrument washer, and suppresses metal part of the medical instrument from corroding.

<Component (A)>

The component (A) of the present invention is an alkanolamine, including those represented by the formula $N(R^1)(R^2)(R^3)$. In the formula, $R^1$ represents a hydrocarbon group with 1 to 8 carbon atoms and 1 to 30H groups. $R^2$ and $R^3$ each independently represent a hydrogen atom, or an alkyl group having 1 to 4 carbon atoms, or an alkanol group having 1 to 4 carbon atoms. $R^1$ preferably represents an alkanol group with 2 to 4 carbon atoms. $R^2$ and $R^3$ preferably each represent a hydrogen atom. Examples of the alkanolamine represented by the formula include monoethanolamine, monopropanolamine, monoisopropanolamine, diethanolamine, triethanolamine, N-methylpropanolamine, N-dimethylethanolamine, 2-amino-2-methyl-1-propanol, and trishydroxyaminomethane. From the viewpoint of detergency, preferred are monoethanolamine, monopropanolamine, monoisopropanolamine, and trishydroxyaminomethane, and more preferred is monoethanolamine.

The present invention can further use an alkaline agent other than the component (A) [hereinafter, referred to as component (A')]. As the component (A'), one or more compounds selected from organic alkaline compounds such as alkylamines and quaternary ammonium compounds, alkaline metal hydroxides, alkali metal carbonates, alkaline metal phosphates, and alkali metal silicates can be used. Examples of alkali metal hydroxides, alkali metal carbonates, alkali metal phosphates, and alkali metal silicates include potassium hydroxide, sodium hydroxide, potassium carbonate, sodium carbonate, potassium phosphate, sodium phosphate, potassium silicate No. 1, sodium silicate No. 1, potassium silicate No. 2, sodium silicate No. 2 and potassium orthosilicate.

From the viewpoint of an efficiency of removing protein dirt, a ratio of the component (A) in the total of components (A) and (A') is preferably not less than 50% by mass, more preferably not less than 60% by mass, even more preferably not less than 70% by mass, even more preferably not less than 80% by mass, and even more preferably not less than 90% by mass.

From the viewpoints of an efficiency of removing protein dirt and influences on costs and base materials, in the treatment liquid used in the present invention, a content of the component (A) is preferably 0.004 to 1% by mass, more preferably 0.01 to 0.5% by mass, even more preferably 0.008 to 0.2% by mass, and even more preferably 0.01 to 0.1% by mass.

In cases of using the component (A'), for further enhancing the efficiency of removing protein dirt, in the treatment liquid used in the present invention, a content of the component (A') is preferably not more than 0.05% by mass, more preferably not more than 0.02% by mass, even more preferably not more than 0.01% by mass, and even more preferably not more than 0.001% by mass.

<Component (B)>

The component (B) of the present invention is a nonionic surfactant. Examples of the nonionic surfactant of the component (B) include polyoxyalkylene alkyl ethers, polyalkylene glycols, alkylamine oxides, polyoxyalkylene alkyl phenyl ethers, fatty acid polyoxyethylene esters, fatty acid sorbitan esters, fatty acids polyoxyalkylene sorbitan esters, fatty acid saccharide esters, alkyl polysaccharides, alkyl glyceryl ethers, and fatty acid alkanolamides. From the viewpoint of an efficiency of removing protein dirt, the component (B) preferably contains at least one nonionic surfactant selected from the group including the following (1) to (4):

(1) polyoxyalkylene ethers represented by the formula (1-1)

$$RO\text{-}(AO)_s\text{—}H \quad (1\text{-}1)$$

(wherein, R represents a hydrocarbon group with 6 to 24 carbon atoms; A represents an alkanediyl group with 2 to 4 carbon atoms; and s represents an average mole number of alkanediyloxy groups added, ranging from 1 to 40);

(2) polyalkylene glycols represented by the formulae (2-1) and (2-2)

$$HO\text{-}(EO)_o\text{—}(PO)_p\text{-}(EO)_q\text{—}H \quad (2\text{-}1)$$

$$HO\text{—}(PO)_p\text{-}(EO)_q\text{—}(PO)_r\text{—}H \quad (2\text{-}2)$$

(wherein, EO represents an ethanediyloxy group; PO represents a propanediyloxy group; and o, p, q, and r each represent an average mole number of groups added, each ranging from 3 to 100);

(3) alkylamine oxides having a hydrocarbon group with 6 to 16 carbon atoms; and (4) alkyl glyceryl ethers having a hydrocarbon group with 6 to 12 carbon atoms.

In the polyoxyalkylene ether (1), R in the formula (1-1) represents a linear or branched hydrocarbon group that is saturated or unsaturated. From the viewpoints of detergency and foaming property, R preferably represents a linear or branched alkyl or alkenyl group, and more preferably a linear or branched alkyl group. The number of carbon atoms in R is 6 to 24, preferably 6 to 18, more preferably 8 to 14, and even more preferably 8 to 10. "A" represents an alkanediyl group with 2 to 4 carbon atoms. From the viewpoints of detergency and foaming property, the number of carbon atoms in A is preferably 2 or 3. "s" represents an average mole number of alkanediyloxy groups added, ranging from 1 to 40, more preferably 2 to 30, and even more preferably 5 to 20. With a polyoxyalkylene ether (1) having plural, different alkanediyl groups, the alkanediyloxy groups may be arranged in block or at random, or may be arranged both in block and at random.

Among polyoxyalkylene ethers (1), preferred are those represented by the formula (1-1-1):

$$RO\text{-}[(EO)_l/(PO)_m]\text{—}H \quad (1\text{-}1\text{-}1)$$

wherein, R represents a hydrocarbon group with 6 to 18 carbon atoms; EO represents an ethanediyloxy group; PO represents a propanediyloxy group; l and m represent average mole numbers of EOs and POs added, respectively, each ranging from 1 to 20; and "/" represents a symbol meaning that EO's and PO's may be arranged at random or in block in any order.

In the polyoxyalkylene ether represented by the formula (1-1-1), R preferably represents an alkyl or alkenyl group, and more preferably an alkyl group, which may be linear or branched. The number of carbon atoms in R is 6 to 18, preferably 6 to 14, and more preferably 7 to 10. R even more preferably represents a branched alkyl group with 8 to 10 carbon atoms. l and m each independently represent the number from 1 to 20, preferably 2 to 15, and more preferably 3 to 10. A ratio of l to m is preferably 3/1 to 1/3, and more preferably 2/1 to 1/2. EO's and PO's may be arranged at random or in block.

Among polyoxyalkylene ethers (1), more preferable are those represented by the formulae (1-1-2) and (1-1-3):

$$RO\text{-}(EO)_{la}\text{—}(PO)_m\text{-}(EO)_{lb}\text{—}H \quad (1\text{-}1\text{-}2)$$

wherein, R represents a hydrocarbon group with 6 to 18 carbon atoms; EO represents an ethanediyloxy group; PO represents a propanediyloxy group; la, lb, and m represent average mole numbers of EO's and PO's added, respectively, each ranging from 1 to 20, with the proviso that la+lb ranges from 2 to 20; and EO's and PO's are arranged in block in the order of EO, PO, and EO; and $$RO\text{-}[(EO)_l/(PO)_m]\text{—}H \quad (1\text{-}1\text{-}3)$$

wherein, R represents a branched alkyl group with 7 to 10 carbon atoms; EO represents an ethanediyloxy group; PO represents a propanediyloxy group; l and m represent average mole numbers of EO's and PO's added, respectively, each ranging from 3 to 10; and "/" represents a symbol meaning that EO's and PO's may be arranged at random or in block in any order.

In the polyoxyalkylene ether represented by the formula (1-1-2), R preferably represents a linear or branched alkyl or alkenyl group, and more preferably a branched alkyl group. The number of carbon atoms in R is 6 to 18, preferably 6 to 14, and more preferably 7 to 10. la, lb, and m each independently represent the number from 1 to 20, preferably 2 to 15, and more preferably 3 to 10, with the proviso that la+lb ranges from 2 to 20, and more preferably 2 to 15. A ratio of (la+lb) to m is preferably 3/1 to 1/3, and more preferably 2/1 to 1/2.

The polyoxyalkylene alkyl ether represented by the formula (1-1-3) may be a commercial product such as Plurafac available from BASF.

Among polyoxyalkylene alkyl ethers represented by the formula (1-1-3), also usable are nonionic surfactants represented by the formula (1-1-3') having EO's and PO's arranged at random:

$$RO\text{-}[(EO)_l\backslash(PO)_m]\text{—}H \qquad (1\text{-}1\text{-}3')$$

wherein, R represents a branched alkyl group with 7 to 10 carbon atoms; EO represents an ethanediyloxy group; PO represents a propanediyloxy group; l and m represent average mole numbers of EO's and PO's added, respectively, each ranging from 3 to 10; and "\" represents a symbol meaning that EO's and PO's are arranged in a random fashion.

In the polyalkylene glycol represented by the formula (2-1) or (2-2), EO represents an ethanediyloxy group; PO represents a propanediyloxy group; and o, p, q, and r each represent an average mole number of groups added, each independently ranging from 3 to 100, more preferably 5 to 30. A ratio of (o+q)/p or q/(p+r) is preferably 3/1 to 1/3, and more preferably 2/1 to 1/2. The polyalkylene glycol represented by the formulae (2-1) and (2-2) may be commercial products such as Pluronic and Pluronic R available from BASF.

The amine oxide (3) has at least one hydrocarbon group with 6 to 16 carbon atoms. The number of carbon atoms is preferably 6 to 14, and more preferably 8 to 12. The hydrocarbon group is an alkyl or alkenyl group. The amine oxide preferably has a linear or branched alkyl group, and more preferably a linear alkyl group. In the amine oxide, a substituent other than the hydrocarbon group with 6 to 16 carbon atoms is preferably an alkyl group with 1 to 3 carbon atoms. Specific examples of the amine oxide include hexylamine oxide, heptylamine oxide, octylamine oxide, 2-ethylhexylamine oxide, isononylamine oxide, decylamine oxide, and dodecylamine oxide.

The glyceryl ether (4) has a hydrocarbon group with 6 to 12 carbon atoms, preferably 6 to 10 carbon atoms, and more preferably 8 to 10 carbon atoms. The hydrocarbon group is an alkyl or alkenyl group, preferably a linear or branched alkyl group, and more preferably a linear alkyl group.

Medical instrument washers, for example, endoscope washers generally use water having no temperature control for cleaning. Even if foaming is no problem when washing is conducted at an ambient temperature, foams can't disappear at a low temperature.

In a washer, water is constantly circulated by injection at high pressure to enhance detergency. Under this condition, water foams up very easily. Once foamed, the foam absorbs a physical power of ultrasonic wave or water stream to conduct a reduced power to the surface of a medical instrument, resulting in reduced detergency. In addition, the foam may cause a false detection by a water level sensor installed in a medical instrument washer, that sensor detects a water level changed according to supply and discharge of washing water, to halt cleaning. The same problems can occur in cases of using water having an extremely low hardness such as RO water and ion-exchanged water. For these reasons, foaming is preferably suppressed even with water having a low hardness at 5° C.

For these reasons and from the viewpoint of an efficiency of removing protein dirt, among nonionic surfactants (1) to (4), at least one nonionic surfactant selected from (1) to (3) is preferable. It is preferable to combine (1) to (3) optionally. The component (B) more preferably contains at least one nonionic surfactant selected from nonionic surfactants (1). Among nonionic surfactants (1), preferred are nonionic surfactants represented by the formula (1-1-2) in which R represents a hydrocarbon group with 6 to 14 carbon atoms and more preferably a branched alkyl group with 7 to 10 carbon atoms and nonionic surfactants represented by the formula (1-1-3), and even more preferable are nonionic surfactants represented by the formula (1-1-3).

From the viewpoint of an efficiency of removing protein dirt and costs, a content of the component (B) in the treatment liquid of the present invention is preferably 0.002 to 1% by mass, more preferably 0.005 to 0.5% by mass, even more preferably 0.008 to 0.3% by mass, and even more preferably 0.01 to 0.1% by mass.

<Component (C)>

The component (C) of the present invention is a polyhydric alcohol.

For a medical instrument made from a light metal being susceptible to alkali corrosion, such as alumite, cleaning with an alkanolamine can corrode the medical instrument. There are many expensive medical instruments such as an endoscope. For these medical instruments, it is a big issue for the instruments to have corrosion in parts by cleaning and be out of commission. However, such corrosion can be prevented by adding a polyhydric alcohol to a treatment liquid used in cleaning.

The polyhydric alcohol of the present invention is a molecule having two or more hydroxy groups, preferably 3 to 10 hydroxy groups, and more preferably 4 to 10 hydroxy groups, and no nitrogen atom in a molecule. Specific examples of the polyhydric alcohol include those having a linear, branched, or cyclic hydrocarbon with 2 to 10 carbon atoms as a backbone, and those having a sugar structure as a backbone, in which at least two hydrogen atoms are substituted with hydroxy groups or a condensate of one to four molecules thereof via ether bonding. The polyhydric alcohol of the present invention may further have other substituent such as a ketone group and an aldehyde group, but preferably no other substituent. The polyhydric alcohol preferably has a linear hydrocarbon with 3 to 6 carbon atoms or a sugar structure with 4 to 12 carbon atoms as a backbone. Specific examples of the polyhydric alcohol include ethylene glycol, propylene glycol, dipropylene glycol, 1,3-butanediol, 1,2-butanediol, dibutylene glycol, 2,4-pentanediol, 1,2-pentanediol, 1,5-pentanediol, 3-methyl-2,4-pentanediol, 1,6-hexanediol, 1,2-hexanediol, glycerol monoalkyl ether, glycerol, 1,2,3-hexanetriol, hexitols (sorbitol, allitol, dulcitol, galactitol, glucitol, mannitol, arytritol, iditol), pentitols (xylitol, arabinitol, ribitol), tetritols (erythritol, threitol), glucose, pentaerythritol, trehalose, maltitol, sucralose, inositol, diglycerol, triglycerol, tetraglycerol, and cyclohexanetetraol. From the viewpoint of protecting a medical instrument against corrosion, the polyhydric alcohol is preferably a compound having three or more hydroxy groups, more preferably 3 to 10 hydroxy groups, and even more preferably 4 to 10 hydroxy groups in a molecule.

The polyhydric alcohol is even more preferably selected from sugar alcohols represented by the following formula:

$$CH_2OH\text{—}(CH(OH))_x\text{—}CH_2OH$$

wherein x represents an integer from 2 to 6, and more preferably selected from hexitols and pentitols, which are sugar alcohols represented by the formula in which x represents an integer from 3 to 4.

Use of a reductive polyhydric alcohol such as glucose may cause coloring by the Maillard reaction between the polyhydric alcohol and an alkanolamine. A polyhydric alcohol without a reductive aldehyde group in a molecule is thus preferably used. From these points, the polyhydric alcohol of the present invention is even more preferably selected from sorbitol and xylitol.

In the present invention, the component (C) preferably contains at least one compound (C1) having 4 to 10 hydroxy groups in a molecule [hereinafter, referred to as component (C1)] as one polyhydric alcohol. The polyhydric alcohol component (C) more preferably further contains at least one polyhydric alcohol (C2) other than the component (C1) [hereinafter, referred to as component (C2)]. Use of the component (C1) or a combination of components (C1) and (C2) is preferable, when the treatment liquid is prepared from a one agent type having a high concentration, in view of an increased anti-corrosive effect and an increased enzyme stabilization and an increased cleaning efficiency. Examples of the compound as the component (C1) include hexitols (sorbitol, allitol, dulcitol, galactitol, glucitol, mannitol, arytritol, iditol), pentitols (xylitol, arabinitol, ribitol), tetritols (erythritol, threitol), pentaerythritol, trehalose, maltitol, sucralose, inositol, diglycerol, triglycerol, tetraglycerol, and cyclohexanetetraol. From the viewpoint of enzyme stabilization, preferred are compounds having 5 to 8 hydroxy groups in a molecule. The component (C1) preferably has no nitrogen atom. It is preferably selected from sugars, more preferably from sugar alcohols, even more preferably from hexitols and pentitols, and even more preferably selected from sorbitol and xylitol. The component (C2) preferably contains a compound having 3 to 6 carbon atoms and two OH groups in a molecule. Examples of the compound include dipropylene glycol, 1,3-butanediol, 1,2-butanediol, dibutylene glycol, 2,4-pentanediol, 1,2-pentanediol, 1,5-pentanediol, 3-methyl-2,4-pentanediol, 1,6-hexanediol, 1,2-hexanediol, glycerol monoalkyl ether, and propylene glycol. The component (C2) more preferably contains a compound having 4 to 6 carbon atoms and two hydroxy groups in a molecule. Examples of the compound include dipropylene glycol, 3-methyl-1,3-butanediol, 3-methyl-1,3-pentanediol, and 2-methyl-2,4-pentanediol. Among them, more preferable are dipropylene glycol and 1,3-butanediol.

In this case, a mass ratio of components (C1) to (C2), (C1)/(C2), is preferably 1/1 to 1/20, more preferably 1/1 to 1/10, and even more preferably 1/2 to 1/5.

From the viewpoints of an anti-corrosive effect and costs, the treatment liquid of the present invention contains the polyhydric alcohol component (C) in an amount of 0.004 to 10% by mass, more preferably 0.01 to 1% by mass, even more preferably 0.02 to 0.5% by mass, and even more preferably 0.05 to 0.2% by mass.

To ensure an anti-corrosive effect of the polyhydric alcohol, an important thing is a blend ratio of the alkanolamine to the polyhydric alcohol. For achieving a sufficient anti-corrosive effect, and from the viewpoints of an anti-corrosive effect and costs, a mass ratio of the alkanolamine component (A) to the polyhydric alcohol component (C), (A)/(C), is preferably 2/1 to 1/50, more preferably 1/1 to 1/20, and even more preferably 2/3 to 1/10.

<Component (D)>

The component (D) of the present invention is an alkaline protease. The alkaline protease is preferably an enzyme having an optimal pH within the range from neutral to basic. A combination of alkaline proteases satisfying the condition may also be used. The component (D) of the present invention preferably contains a subtilisin protease derived from *Bacillus* SP, and more preferably a subtilisin protease derived from *Bacillus halodurans* or *Bacillus clausii*. The alkaline protease being available in the commercial market includes Alcalase, Savinase, Everlase, Esperase, Kannase, and Ovozyme, which are available from Novozymes Japan Ltd., and Purafect and Properase, which are available from Genencor International Inc. An alkaline protease described in JP-A2007-61101 may also be preferably used.

The treatment liquid of the present invention contains the component (D) in an effective amount. Specifically, from the viewpoints of an efficiency of removing fixed protein and costs, a content (proteolytic activity) of the component (D) in the treatment liquid of the present invention is preferably 0.01 to 200 PU, more preferably 0.05 to 100 PU, even more preferably 0.1 to 50 PU, and even more preferably 0.5 to 20 PU per kilogram of treatment liquid.

The proteolytic activity (PU/g) is determined by the following method: It includes warming 1 mL of 50 mmol/L boric acid buffer (pH 10.5) containing 1 w/v % casein (Hammersten, Merck Ltd.) for 5 minutes at 30° C.; mixing it with a solution containing 0.1 g of enzyme to react for 15 minutes at 30° C.; adding 2 mL of stop solution (0.11 mol/L trichloroacetic acid-0.22 mol/L sodium acetate-0.33 mol/L acetic acid) to the reaction mixture and allowing to stand for 10 minutes at a room temperature; separating an acid-denatured protein by filtration (No. 2 filter paper, Whatman Ltd.) to give a filtrate; adding 2.5 mL of alkaline copper solution [aqueous solution of 1 w/v % potassium sodium tartrate:aqueous solution of 1 w/v % copper sulfate:solution prepared by dissolving sodium carbonate in an aqueous solution of 0.1 mol/L sodium hydroxide (concentration of sodium carbonate: 2 w/v %)=1:1:100 (V/V)] to 0.5 mL of filtrate and warming the mixture for 10 minutes at 30° C.; further adding 0.25 mL of dilution of a phenol reagent [prepared by diluting the phenol reagent (Kanto Chemical Co., Inc.) in ion-exchanged water to double the volume] and holding for 30 minutes at 30° C. to give a sample; and measuring an absorbance of the sample at 660 nm. A blank was prepared by mixing the enzyme reaction system as described above with the stop solution and then adding the enzyme solution to the mixture, and measured for 660 nm absorbance in the same way. A difference of absorbance between a sample and a blank is used to calculate an amount of an acid-soluble proteolysate released in the sample (an amount corresponding to an amount of tyrosine). The amount is divided by a reaction time (in this case, 15 minutes) and an amount of an enzyme solution (in this case, 0.1 g) to give a proteolytic activity. As used herein, 1 PU refers to an amount of an enzyme that releases an acid-soluble proteolysate, corresponding to 1 mmol of tyrosine through the reaction for one minute under the above-described reaction conditions.

<pH of the Treatment Liquid for Cleaning a Medical Instrument>

The treatment liquid of the present invention has a pH of not less than 9. The pH is an essential factor not only for enhancing a performance of the treatment liquid to clean off dirt with an alkali component, but also for increasing an activity of the alkaline protease. Some medical instruments, for example, soft endoscopes are cleaned for about 10 minutes at ambient temperature, because these should be treated within a short time and could be damaged at higher temperature. A treatment liquid having a pH of 9 or lower cannot clean an endoscope under normal cleaning conditions for endoscope to the extent that there is no recognizable protein by staining. A treatment liquid having extremely high pH can corrode a metal part of a medical instrument. However, the treatment liquid of the present invention can be used without these problems. From the viewpoints of detergency and protection of a metal from corrosion, the treatment liquid of the present invention has a pH of not less than 9, preferably 9.5 to 13, more preferably 10 to 12, and even more preferably 10.2 to 11.

The pH of the treatment liquid of the present invention refers to a value in cleaning, or may a value measured at 25° C.

In the present invention, use of the treatment liquid containing components (A), (B), (C), and (D) and having a specific pH enables to thoroughly remove protein dirt among various dirt such as of blood, without corroding a metal used in the medical instrument. The protein dirt is not only visible portion of protein dirt over the fixed dirt on a hard surface or the like, but also protein dirt directly contacting with the surface of a base material and fixing thereon. In the present invention, the component (E) may be tap water, RO water, ion-exchanged water, distilled water, or pure water. The component (E) is used in such amount as constituting the rest part of the treatment liquid.

<Other Components that can be Formulated in the Treatment Liquid of the Present Invention>

The treatment liquid of the present invention can further contain other component (s) within the range that does not impair the effects of the present invention, including a sequestering agent, other surfactant than the component (B), a water-soluble solvent, a hydrotrope agent, a dispersant, a pH-adjusting agent, a thickener, a viscosity-adjusting agent, a perfume, a colorant, an antioxidant, a preservative, an antifoaming agent, a bleach, and a bleach activator, and the like. These components may be added to a concentrate of the treatment liquid.

The treatment liquid of the present invention preferably further contains a sequestering agent. The addition of the sequestering agent makes the treatment liquid more effective to remove protein dirt fixed through bonding with an alkaline earth metal ion or an alkaline earth metal salt.

Any sequestering agent can be used, including aminocarboxylic acid, organic acid, phosphonic acid, phosphoric acid, and polycarboxylic acid sequestering agents. Examples of the sequestering agent include aminopolyacetic acids such as nitrilotriacetic acid, iminodiacetic acid, ethylenediaminetetraacetic acid, diethylenetriaminepentaacetic acid, glycol ether diaminetetraacetic acid, hydroxyethyliminodiacetic acid, triethylenetetraaminehexaacetic acid, and djenkolic acid, and salts thereof; organic acids such as diglycolic acid, oxydisuccinic acid, carboxymethyloxysuccinic acid, citric acid, lactic acid, tartaric acid, oxalic acid, malic acid, gluconic acid, carboxymethylsuccinic acid, carboxymethyltartaric acid, and glutamic acid diacetate, and salts thereof; phosphonic acids such as aminotri(methylenephosphonic acid), 1-hydroxyethylidene-1,1-diphosphonic acid, ethylenediaminetetra(methylenephosphonic acid), and diethylenetriaminepenta(methylenephosphonic acid), and salts thereof; phosphoric acids such as tripolyphosphoric acid and salts thereof; and polycarboxylic acids such as polyacrylic acid and salts thereof. Among these agents, preferred are ethylenediaminetetraacetic acid, polyacrylic acid, and salts thereof.

Examples of a counter ion of these salts include alkali metals, quaternary amines, and alkanolamines. From the viewpoint of protection of a medical instrument from corrosion, the sequestering agent is preferably an alkanolamine salt, and more preferably a monoethanolamine salt. When a sequestering agent is used in the treatment liquid of the present invention and an alkanolamine salt is used as a salt thereto, the amount corresponding to the alkanolamine is included in the component (A).

From viewpoints of an efficiency of removing protein dirt and costs, a content of the sequestering agent in the treatment liquid of the present invention is preferably 0.002 to 0.5% by mass, more preferably 0.005 to 0.3% by mass, even more preferably 0.01 to 0.2% by mass, and even more preferably 0.02 to 0.1% by mass.

The treatment liquid of the present invention can further contain a surfactant other than the component (B). The other surfactant may be an anionic surfactant, a cationic surfactant, or an amphoteric surfactant, preferably a surfactant selected from fatty acid salts, alkyl ether carboxylates, alkylsulfates, and alkyl ether sulfates. It is more preferably a surfactant having an alkyl group with 6 to 8 carbon atoms. The alkyl group may be linear or branched. Specific examples of the other surfactant include octyl sulfate, caprylates, and caproates. A mass ratio of the component (B) to the other surfactant than (B), component (B)/other surfactant, is preferably 4/1 to 1/4, and more preferably 1/2 to 2/1.

The treatment liquid having a preferred composition of the present invention contains the alkanolamine component (A) in an amount of 0.01 to 0.11% by mass, the nonionic surfactant component (B) in an amount of 0.01 to 0.1% by mass, the polyhydric alcohol component (C) in an amount of 0.02 to 0.5% by mass, and the alkaline protease component (D) at an activity of 0.5 to 20 PU/kg. Such a composition further contains even more preferably a sequestering agent in an amount of 0.02 to 0.1% by mass.

The treatment liquid of the present invention can further contain an enzyme stabilizer, including a water-soluble calcium salt, boric acid or a salt thereof, a boron compound such as borax, or formic acid or a salt thereof.

The treatment liquid of the present invention can further contain a water-soluble solvent. Examples of the water-soluble solvent include alcohols having a hydroxy group in a molecule such as ethanol and propanol, and glycol ethers having a hydroxy group in a molecule such as ethylene glycol ethyl ether, propylene glycol ethyl ether, ethylene glycol butyl ether, and diethylene glycol butyl ether. Examples of a hydrotrope agent include p-toluenesulfonic acid, benzoic acid, xylenesulfonic acid and salts thereof, and ureas. Examples of a dispersant include polyvinylpyrrolidone. Examples of an antioxidant include butyl hydroxytoluene, sodium sulfite, and sodium hydrogensulfite. Examples of an antifoaming agent include polypropylene glycols having an average molecular weight of 500 to 10000, polypropylene glycol alkyl ethers having 8 to 18 carbon atoms and an average mole number of polypropylene glycols added of 1 to 10, silicone, and silica.

The treatment liquid of the present invention can further contain a pH-adjusting agent. Examples of the pH-adjusting agent include gluconic acid, malic acid, succinic acid, and acetic acid.

<Composition for Producing the Treatment Liquid>

The treatment liquid of the present invention may be prepared, when used, not only by blending components and adjusting concentrations thereof, but also by diluting a composition for producing the treatment liquid, having high concentrations, previously prepared, such that a diluted composition has concentrations within a predetermined ranges. Examples of the composition for producing the treatment liquid include those containing all four, three, two, and one of components (A) to (D). The composition for producing the treatment liquid preferably contains water. The treatment liquid of the present invention can be prepared from these compositions by diluting a single composition, mixing compositions and diluting a mixture, or diluting compositions separately and mixing them, or the like. Although the composition can contain components in any combination, for containing the component (D) more stably, the composition is preferably a composition containing the component (D) without components (A), (B), or (C), or a composition containing components (C) and (D) without components (A) and (B). Specific examples of the more preferred composition for producing the treatment liquid include:

(I) a composition containing all four of components (A) to (D);

(II) a composition containing components (A), (B) and (C);

(III) a composition containing components (A) and (B);

(IV) a composition containing components (C) and (D); and (V) a composition containing only the component (D).

One or more of these compositions are used to prepare the treatment liquid ultimately containing all four of components (A) to (D). The component (D) reduces an enzyme activity for a short time when mixed, for example, with an alkaline agent or a sequestering agent. However, from the viewpoint of convenience in use, the composition (I) containing all four components is preferred. From the viewpoint of enzyme stability, the treatment liquid is preferably prepared from a combination of two compositions (II) and (V) or (III) and (IV). When two or more compositions for the treatment liquid are combined, components for enhancing detergency, such as a sequestering agent, can be easily and preferably added. In the present invention, the treatment liquid is preferably prepared from a composition for producing a treatment liquid containing at least the polyhydric alcohol component (C) and the alkaline protease component (D) and at least one composition for producing a treatment liquid other than the composition for producing a treatment liquid containing at least the polyhydric alcohol component (C) and the alkaline protease component (D).

From the viewpoints of solubility, compatibility to a washer, and metric accuracy, the composition for producing the treatment liquid is preferably in a liquid state.

In the composition for producing the treatment liquid of the present invention, respective concentrations of components are as follows. From the viewpoints of detergency, safety in handling, and costs, the component (A) is preferably 1 to 30% by mass, more preferably 3 to 25% by mass, and even more preferably 5 to 20% by mass. From the viewpoints of detergency, antifoaming property, and stability in a composition, the component (B) is preferably 1 to 30% by mass, more preferably 2 to 20% by mass, and even more preferably 3 to 10% by mass. From the viewpoints of storage stability of an enzyme and protection of a metal from corrosion, the component (C) is preferably 10 to 80% by mass, more preferably 20 to 75% by mass, even more preferably 30 to 70% by mass, and even more preferably 40 to 60% by mass. From the viewpoints of an efficiency of removing a fixed protein and costs, in the treatment liquid of the present invention, a content (proteolytic activity) of the component (D) is preferably 0.01 to 200 PU, more preferably 0.05 to 100 PU, even more preferably 0.1 to 50 PU, even more preferably 0.5 to 20 PU per gram of composition for producing the treatment liquid.

In the treatment liquid prepared by diluting a composition for producing the treatment liquid, the component (D) is less stable than the composition for producing the treatment liquid. The dilution is therefore preferably conducted immediately before cleaning a medical instrument, or contacting the treatment liquid with the medical instrument.

In cases of using a medical instrument washer, the treatment liquid can be pumped to the washer during cleaning.

In cases of using two or more compositions for the treatment liquid in cleaning, these components are preferably separately added to water to prepare the treatment liquid in order to keep an enzyme activity of the component (D) better.

The composition for producing the treatment liquid containing all four components preferably contains water in an amount of not more than 30% by mass. In the composition having the lower content of water, an enzyme can maintain its higher-order structure more stably. In this case, a polyhydric alcohol of the component (C) is effective for stabilizing the enzyme.

In cases of using two or more compositions for the treatment liquid, an enzyme can be stabilized in the same way. A common medical instrument washer includes a tank for storing a thick composition for a treatment liquid and a pump unit for pumping the thick composition to a washing tank. A washer including two or more systems of the tank and the pump unit can blend two or more compositions for a treatment liquid, separately from one another, with water to provide a treatment liquid. A desired ingredient may be added to the treatment liquid during cleaning. A composition for producing the treatment liquid containing a component that most affects on an enzyme stability can be separately prepared from a composition containing an enzyme, and thus the enzyme can be formulated more stably. In addition, in the case of mixing two or more compositions, the composition of treatment liquid can be optimized to enhance a cleaning performance in consideration of a temperature and a hardness of water used in cleaning and a type and a degree of dirt of an endoscope to be cleaned.

A composition for producing the treatment liquid containing the nonionic surfactant component (B) has high clouding point and may separate at high temperature. To prevent the separation, the composition can further contain a surfactant other than the component (B). The addition of the other surfactant however poses a problem of reduced detergency due to foaming in cleaning a medical instrument. To avoid this problem, the other surfactant added is preferably a surfactant having an alkyl group with 6 to 10 carbon atoms. Such a surfactant may be anyone of an anionic surfactant, a cationic surfactant and an amphoteric surfactant. The surfactant is preferably selected from fatty acid salts, alkyl ether carboxylates, alkylsulfates, and alkyl ether sulfates, and more preferably from octyl sulfate, caprylates, and caproates. A blend mass ratio of the component (B) to the other surfactant, component (B)/other surfactant, is preferably 4/1 to 1/4, and more preferably 1/2 to 2/1.

The composition for producing the treatment liquid can further contain an enzyme stabilizer selected from water-soluble calcium salts, boric acid and salts thereof, boron compounds such as borax, and formic acid and salts thereof in an amount of 0.01 to 5% by mass.

The composition for producing the treatment liquid of the present invention preferably has a pH of not lower than 10.5. From the viewpoints of detergency and protection of a metal from corrosion, the pH is more preferably 11.0 to 13.0, even more preferably 11.2 to 12.5, and even more preferably 11.4 to 12.0.

The pH of the composition for producing the treatment liquid of the present invention is determined by measuring a pH of a stock solution of the composition at 25° C.

In automatic preparation of the treatment liquid through supply of a composition for producing the treatment liquid to a medical instrument washer, the lower viscosity preferably makes the composition the easier to be supplied. In this case, the viscosity of the composition at 5° C. is preferably not more than 10000 mPa·s, more preferably not more than 1000 mPa·s, and even more preferably not more than 300 mPa·s.

<Preparation of the Treatment Liquid>

The composition for producing the treatment liquid according to the present invention can be diluted with water to prepare a treatment liquid. From the viewpoints of workability and economic efficiency, one or two or more compositions for the treatment liquid are preferably diluted with water, such as tap water, RO water, ion-exchanged water, distilled water or pure water, 50 to 5000 times, more preferably 50 to 2000 times, and even more preferably 100 to 1000 times to prepare the treatment liquid. In cases of using several compositions for the treatment liquid, these compositions may be separately diluted and then combined together to give a treatment liquid. In preparation of a treatment liquid by diluting a composition for producing the treatment liquid, the prepared treatment liquid has at least a composition according to the present invention. With plural compositions, diluting ratios may be the same as or different from one another.

<Cleaning with the Treatment Liquid>

Examples of the medical instrument that can be cleaned by the method of the present invention include steel instruments such as scissors, forceps, and tweezers, resin instruments such as catheters, tubes, bite blocks and hard and soft endoscopes.

The method for cleaning of the present invention includes a step of contacting a treatment liquid with a medical instrument, wherein the treatment liquid contains the component (A) in an amount of 0.004 to 1% by mass, the component (B) in an amount of 0.002 to 1% by mass, the component (C) in an amount of 0.004 to 10% by mass, the component (D) in an effective amount, and water (E), and has a pH of not lower than 9. This step of contacting can be incorporated, for example, into a cleaning of a medical instrument with a medical instrument washer. It is therefore a preferred aspect that a method for cleaning a medical instrument with a medical instrument washer and includes contacting the treatment liquid with a medical instrument.

The treatment liquid can be brought to contact with a part of the medical instrument at which protein dirt derived from blood or the like is attached by being applied by coating, dipping, or spraying. In contacting, a temperature of the treatment liquid is preferably 5 to 50° C., and more preferably 10 to 40° C. A contacting time of the treatment liquid is preferably 30 seconds to 30 minutes, and more preferably 1 minute to 15 minutes.

EXAMPLES

The following Examples demonstrate the present invention. Examples are intended to illustrate the present invention and not to limit the present invention.

Example 1 and Comparative Example 1

Compositions for a treatment liquid in Tables 1 and 2 were diluted with water at respective dilution rates shown in Tables to prepare treatment liquids. These liquids were subjected to evaluations for [I] cleaning performance in removal of protein dirt derived from blood, [II] compatibility with a washer, and [III] protection of alumite from corrosion. The cleaning performance was evaluated by three methods of visual judgment, protein-staining method, and fluorescent stain. Results are shown in Tables 1 and 2. In these examples, a pH was measured with a pH meter F-21 (Horiba Ltd.).

[I] Cleaning Performance

[I-1] Methods of Visual Judgment and Protein Stain

To 0.5 mL of heparinized ovine blood was added 7.5 μL of protamine sulfate solution, and immediately stirred. The mixture was uniformly applied on a polycarbonate plate at a rate of 10 μL/cm$^2$ and dried for two hours at a room temperature to prepare a test piece.

In a 100 mL glass beaker, 100 mL of each treatment liquid in Tables 1 and 2 was introduced and adjusted to 30° C. A test piece prepared as above was immersed therein for 20 minutes, and then rinsed gently with ion-exchanged water. For evaluating a cleaning performance, the test piece was first examined visually about an amount of blood remaining (method of visual judgment), then immersed in a Coomassie Protein Assay Reagent (attached reagent to a protein quantifying kit, Thermo Fisher Scientific K. K.) for three minutes, fully rinsed with ion-exchanged water, and then examined and rated about a stained state according to the following rating (protein-staining method). Examination by the method of protein stain was repeated five times to calculate an average. In Tables 1 and 2, the average was shown.

Rating for Visual Judgment

A: there is no blood remaining

B: there is a trace amount of blood remaining

C: there is a large amount of blood remaining

Rating of a Stained State

5: almost no area is stained

4: about a half or less area of the blood-applied surface is lightly stained

3: about a half or more area of the blood-applied surface is lightly stained

2: about a half or less area of the blood-applied surface is deeply stained

1: about a half or more area of the blood-applied surface is deeply stained

A test piece earned a 3 or higher rating is considered as having only invisible protein dirt in a trace amount and being cleaned to an enough degree to be reused with no problem.

[I-2] Fluorescent-Staining Method

A test piece cleaned in the same way as in [I-1] was stained with a SYPRO Ruby Protein Gel Stain (SIGMA CORPORATION) for 10 minutes, fully rinsed with distilled water, dried, and observed under a fluorescence microscope (Keyence Corporation, Biozero) with a 20-magnification object lens. Images were formed by irradiating an exciting light at 470 nm for different exposure times and detecting an emitted fluorescence at 510 nm or higher, and displayed on a monitor. An image on the monitor was rated according to the following rating. The shorter exposure time taken for fluorescence development is, the larger the amount of protein is.

Rating for Fluorescent Stain

5: almost no stained area produces fluorescence by exposure for 3 seconds

4: a part of stained area produces fluorescence by exposure for 3 seconds

3: a part or no stained area produces fluorescence by exposure for 0.3 second or shorter, but almost all of stained area produces fluorescence by exposure for more than 0.3 second and less than 3 seconds.

2: a part or no stained area produces fluorescence by exposure for 0.03 second or shorter, but almost all of stained area produces fluorescence by exposure for more than 0.03 second and less than 0.3 second.

1: almost all of stained area produces fluorescence by exposure for 0.03 second.

A test piece earned a 3 or higher rating is considered as having only invisible protein dirt in a trace amount and being cleaned to an enough degree to be reused with no problem.

[II] Compatibility with a Washer

A washer used was an endoscope cleaning and sterilization system OER-3 (Olympus Medical Systems Corp.). The washer was set to a cleaning time of 10 minutes. A treatment liquid was placed in a cleaning tank, and the washer was put into action. Working conditions of the washer were monitored during in action, and rated according to the following rating.

4: even with setting a temperature of supply water to 5° C., there is no significant foaming problematic to a step of cleaning.

3: with setting a temperature of supply water to 5° C., foaming is a little increased, but the foam does not overflow or a sensor does not halt the washer by detecting an abnormality.

2: with setting a temperature of supply water to 5° C., in some cases, foams overflowed or a sensor detected an abnormality to halt the washer, but with 35° C., the washer can finish with cleaning, having no problem.

1: even with setting a temperature of supply water to 35° C., foam overflows or a sensor halts the washer by detecting an abnormality and the washer therefore cannot finish with cleaning.

A treatment liquid earned a 1 rating cannot be used for cleaning a medical instrument, but a treatment liquid earned a 2 or higher rating can be used by at least controlling a temperature of the treatment liquid.

[III] Protection of Alumite from Corrosion

In a 50 mL glass screw vial No. 7 containing 20 mL of treatment liquid, a weighed standard alumite test plate having dimensions of 50 mm length, 20 mm width, and 1 mm thickness (Nippon Testpanel Co., Ltd.) was half-immersed and stored for 4 days at 50° C. in this state. Then, the test plate was taken off, fully washed in flowing water, sufficiently dried, and weighed to determine an absolute value of a mass change. This test accelerates corrosion at a high temperature. A treatment liquid causing a mass change of not more than 7 mg is considered as not problematically corrosive to alumite for an usual cleaning for about 10 minutes at 35° C. or lower.

TABLE 1

| | | | Example | | | | | | | | | |
|---|---|---|---|---|---|---|---|---|---|---|---|---|
| | | | 1-1 | 1-2 | 1-3 | 1-4 | 1-5 | 1-6 | 1-7 | 1-8 | 1-9 | 1-10 |
| Composition for producing treatment liquid | Composition (mass %) | (A) Monoethanolamine | 10 | 12.5 | 5 | 10 | 10 | 10 | 10 | 10 | 6 | 20 |
| | | Potassium hydroxide | | | | | | | | | 2 | |
| | | Sodium hydroxide | | | | | | | | | | |
| | | Potassium carbonate | | | | | | | | | 2 | |
| | | (B) Nonionic surfactant A | 5 | 6 | 2.5 | 5 | 5 | | | | 5 | |
| | | Nonionic surfactant B | | | | | | 5 | | | | |
| | | Nonionic surfactant C | | | | | | | 5 | | | |
| | | Nonionic surfactant D | | | | | | | | 5 | | |
| | | Anionic surfactant | | | | | | | | | | |
| | | (C) Sorbitol | 15 | 15 | | | 20 | 20 | 20 | 20 | 20 | 20 |
| | | Xylitol | | | 10 | | | | | | | |
| | | Glycerol | | | | 20 | | | | | | |
| | | Dipropylene glycol | 45 | 42.5 | | | | | | | | |
| | | (D) Alkaline protease | 5 | 5 | 2.5 | 5 | 5 | 5 | 5 | 5 | 5 | 5 |
| | | EDTA4Na | | | 1 | 2 | 2 | 2 | 2 | 2 | 2 | 2 |
| | | Boric acid | | | | | | | | | | |
| | | Ion-exchanged water | Balance | Balance | Balance | Balance | Balance | Balance | Balance | Balance | Balance | Balance |
| | | Total | 100 | 100 | 100 | 100 | 100 | 100 | 100 | 100 | 100 | 100 |
| | pH(25° C.) | | 11.7 | 11.8 | 11.2 | 11.7 | 11.7 | 11.7 | 11.7 | 11.7 | 12.8 | 11.9 |
| Dilution rate | | | 200 | 300 | 100 | 200 | 200 | 200 | 200 | 200 | 200 | 200 |
| Treatment liquid | Composition (mass %) | (A) Monoethanolamine | 0.05 | 0.042 | 0.05 | 0.05 | 0.05 | 0.05 | 0.05 | 0.05 | 0.03 | 0.2 |
| | | Potassium hydroxide | | | | | | | | | 0.01 | |
| | | Sodium hydroxide | | | | | | | | | | |
| | | Potassium carbonate | | | | | | | | | 0.01 | |
| | | (B) Nonionic surfactant A | 0.025 | 0.02 | 0.025 | 0.025 | 0.025 | | | | 0.025 | 0.025 |
| | | Nonionic surfactant B | | | | | | 0.025 | | | | |
| | | Nonionic surfactant C | | | | | | | 0.025 | | | |
| | | Nonionic surfactant D | | | | | | | | 0.025 | | |
| | | Anionic surfactant | | | | | | | | | | |
| | | (C) Sorbitol | 0.075 | 0.05 | | | 0.1 | 0.1 | 0.1 | 0.1 | 0.1 | 0.1 |
| | | Xylitol | | | 0.1 | | | | | | | |
| | | Glycerol | | | | 0.1 | | | | | | |
| | | Dipropylene glycol | 0.225 | 0.142 | | | | | | | | |
| | | (D) Alkaline protease (※) | 0.025 | 0.017 | 0.025 | 0.025 | 0.025 | 0.025 | 0.025 | 0.025 | 0.025 | 0.025 |
| | | EDTA4Na | | | 0.01 | 0.01 | 0.01 | 0.01 | 0.01 | 0.01 | 0.01 | 0.01 |
| | | Boric acid | | | | | | | | | | |
| | | Ion-exchanged water | Balance | Balance | Balance | Balance | Balance | Balance | Balance | Balance | Balance | Balance |
| | | Total | 100 | 100 | 100 | 100 | 100 | 100 | 100 | 100 | 100 | 100 |
| | pH(25° C.) | | 10.3 | 10.3 | 10.5 | 10.6 | 10.7 | 10.6 | 10.7 | 10.8 | 11.3 | 11.1 |
| Evaluation of detergency | | Visual judgement | A | A | A | A | A | A | A | A | A | A |
| | | Rating of protein stain | 4.2 | 4 | 4.6 | 4.6 | 4.6 | 4.8 | 4.6 | 4.6 | 4.6 | 4.8 |
| | | Rating of fluorescent stain | 4 | 4 | 5 | 5 | 5 | 4 | 4 | 4 | 4 | 5 |
| Compatibility with a washer | | | 4 | 4 | 4 | 4 | 4 | 3 | 2 | 2 | 4 | 4 |
| Mass change of alumite (mg) | | | 1.5 | 1.3 | 3.5 | 4.5 | 1.8 | 1.2 | 1.6 | 2.3 | 1.4 | 5.9 |

(※) An amount of 0.025% by mass of the alkaline protease (12 (PU/g)) corresponds to 3 PU per kilogram of treatment liquid.

TABLE 2

| | | | Comparative example | | | | | | | | |
|---|---|---|---|---|---|---|---|---|---|---|---|
| | | | 1-1 | 1-2 | 1-3 | 1-4 | 1-5 | 1-6 | 1-7 | 1-8 | 1-9 |
| Composition for treatment liquid | Composition (mass %) | (A) Monoethanolamine | | | | | 10 | 10 | 10 | 10 | 10 |
| | | Potassium hydroxide | | 10 | | | | | | | |
| | | Sodium hydroxide | | | 10 | | | | | | |
| | | Potassium carbonate | | | | 10 | | | | | |
| | | (B) Nonionic surfactant A | 5 | 5 | 5 | 5 | | | 5 | 5 | 5 |
| | | Nonionic surfactant B | | | | | | | | | |
| | | Nonionic surfactant C | | | | | | | | | |
| | | Nonionic surfactant D | | | | | | | | | |
| | | Anionic surfactant | | | | | | 5 | | | |
| | | (C) Sorbitol | 20 | 20 | 20 | 20 | 20 | 20 | | 20 | 20 |
| | | Xylitol | | | | | | | | | |
| | | Glycerol | | | | | | | | | |
| | | Dipropylene glycol | | | | | | | | | |
| | | (D) Alkaline protease | 5 | 5 | 5 | 5 | 5 | 5 | 5 | | 5 |
| | | EDTA4Na | 2 | 2 | 2 | 2 | 2 | 2 | 2 | 2 | |
| | | Boric acid | | | | | | | | | 6 |
| | | Ion-exchanged water | Balance | Balance | Balance | Balance | Balance | Balance | Balance | Balance | Balance |
| | | Total | 100 | 100 | 100 | 100 | 100 | 100 | 100 | 100 | 100 |
| | pH(25° C.) | | 9.3 | 13.2 | 13.1 | 12.8 | 11.7 | 11.5 | 11.7 | 11.7 | 7.2 |
| Dilution rate | | | 200 | 200 | 200 | 200 | 200 | 200 | 200 | 200 | 200 |
| Treatment liquid | Composition (mass %) | (A) Monoethanolamine | | | | | 0.05 | 0.05 | 0.05 | 0.05 | 0.05 |
| | | Potassium hydroxide | | 0.05 | | | | | | | |
| | | Sodium hydroxide | | | 0.05 | | | | | | |
| | | Potassium carbonate | | | | 0.05 | | | | | |
| | | (B) Nonionic surfactant A | 0.025 | 0.025 | 0.025 | 0.025 | | | 0.025 | 0.025 | 0.025 |
| | | Nonionic surfactant B | | | | | | | | | |
| | | Nonionic surfactant C | | | | | | | | | |
| | | Nonionic surfactant D | | | | | | | | | |
| | | Anionic surfactant | | | | | | 0.025 | | | |
| | | (C) Sorbitol | 0.1 | 0.1 | 0.1 | 0.1 | 0.1 | 0.1 | | 0.1 | 0.1 |
| | | Xylitol | | | | | | | | | |
| | | Glycerol | | | | | | | | | |
| | | Dipropylene glycol | | | | | | | | | |
| | | (D) Alkaline protease(X) | 0.025 | 0.025 | 0.025 | 0.025 | 0.025 | 0.025 | 0.025 | | 0.025 |
| | | EDTA4Na | 0.01 | 0.01 | 0.01 | 0.01 | 0.01 | 0.01 | 0.01 | 0.01 | |
| | | Boric acid | | | | | | | | | 0.03 |
| | | Ion-exchanged water | Balance | Balance | Balance | Balance | Balance | Balance | Balance | Balance | Balance |
| | | Total | 100 | 100 | 100 | 100 | 100 | 100 | 100 | 100 | 100 |
| | pH(25° C.) | | 8.2 | 12.4 | 12.4 | 12.1 | 10.8 | 10.5 | 10.7 | 10.9 | 8.1 |
| Evaluation of detergency | | Visual judgment | C | A | A | A | A | A | A | A | C |
| | | Rating of protein stain | 1 | 3.2 | 2.8 | 1.8 | 1.4 | 3.2 | 3.8 | 1.6 | 1.4 |
| | | Rating of fluorescent stain | 1 | 2 | 2 | 1 | 2 | 2 | 3 | 1 | 2 |
| Compatibility with a washer | | | 4 | 4 | 4 | 4 | 4 | 1 | 4 | 4 | 4 |
| Mass change of alumite (mg) | | | 0.8 | 26.8 | 17.6 | 10.7 | 1.7 | 2.7 | 10.6 | 2.2 | 0.8 |

(X)An amount of 0.025% by mass of the alkaline protease (12 (PU/g)) corresponds to 3 PU per kilogram of treatment liquid.

In Tables, components used are as follows:

nonionic surfactant A: nonionic surfactant represented by the formula (1-1-3) in which R represents a branched alkyl group with 9 carbon atoms, l=9.0, m=5.2, and EO's and PO's are arranged at random (Plurafac LF 901 (BASF Japan Ltd.), this nonionic surfactant is also represented by the formula (1-1-3'))

nonionic surfactant B: nonionic surfactant represented by the formula (1-1-2) in which R represents a linear alkyl group with 12 to 14 carbon atoms, la=3.0, m=1.5, and lb=3.0 (Emulgen LS106 (Kao Corporation))

nonionic surfactant C: Penetol GE-EH (2-ethylhexyl glyceryl ether, Kao Corporation)

nonionic surfactant D: Amphitol 20N (lauryldimethylamine oxide, Kao Corporation)

alkaline protease: Savinase 16L [Novozymes Japan Ltd., 12 (PU/g)]

As can be seen from Tables 1 and 2, in Examples using a treatment liquid containing components (A), (B), (C), and (D), and having a pH of not lower than 9, protein dirt fixed on the surface of a base material was effectively removed. The method of fluorescent stain used in Examples was highly sensitive to a trace amount of protein dirt that cannot be detected by conventional tests (amido black-staining, o-toluidine method and the like). According to the method for cleaning of the present invention, protein dirt could hardly be detected even by such a sensitive test. These results show a great cleaning performance of the method of the present invention.

Protein dirt is generally assumed to increase its solubility in a solvent with increasing pH to alkalinity and to be more easily removed for a good cleaning. Treatment liquids not containing the component (A) and those other alkaline agent than (A) to bring pH to alkalinity were found to fail to entirely remove protein dirt, fixed on the surface of a base material, as shown in Comparative Examples 1-1 to 1-4.

From Comparative Example 1-5, a treatment liquid not containing the component (B) was found to fail to entirely remove dirt fixed on the surface of a base material. From Comparative Example 1-6, use of an anionic surfactant was found to reduce detergency and seriously impair compatibility with a washer.

From Comparative Example 1-7, a treatment liquid not containing the component (C) was found to corrode alumite.

From Comparative Example 1-8, a treatment liquid not containing an alkaline protease as the component (D) was found to fail to remove protein dirt, allowing the most of protein dirt fixed on the surface of a base material to leave there, while removing visible dirt.

From Comparative Example 1-9, even a treatment liquid containing components (A), (B), (C), and (D) was found to reduce significantly its detergency by being brought its pH to near to neutral with boric acid.

Example 2 and Comparative Example 2

Treatment liquids shown in Table 3 were prepared and evaluated in the same way as in Example 1. Results are shown in Table 3. Components in Table 3 were same to those used in Example 1 and Comparative Example 1. A pH was measured with a pH meter F-21 (Horiba Ltd.).

TABLE 3

| | | | | Example | | | | | | Comparative example | | | | |
|---|---|---|---|---|---|---|---|---|---|---|---|---|---|---|
| | | | | 2-1 | 2-2 | 2-3 | 2-4 | 2-5 | 2-6 | 2-1 | 2-2 | 2-3 | 2-4 | 2-5 |
| Treatment liquid | Composition (mass %) | (A) | Monoethanolamine | 0.01 | 0.15 | 0.05 | 0.05 | 0.05 | 0.05 | 0.002 | 2 | 0.05 | 0.05 | 0.05 |
| | | (B) | Nonionic surfactant A | 0.025 | 0.025 | 0.005 | 0.1 | 0.025 | 0.025 | 0.025 | 0.025 | 0.001 | 2 | 0.025 |
| | | (C) | Sorbitol | 0.1 | 0.1 | 0.1 | 0.1 | 0.02 | 0.5 | 0.1 | 0.1 | 0.1 | 0.1 | 0.002 |
| | | (D) | Alkaline protease(※) | 0.025 | 0.025 | 0.025 | 0.025 | 0.025 | 0.025 | 0.025 | 0.025 | 0.025 | 0.025 | 0.025 |
| | | EDTA•4Na | | 0.01 | 0.01 | 0.01 | 0.01 | 0.01 | 0.01 | 0.01 | 0.01 | 0.01 | 0.01 | 0.01 |
| | | Ion-exchanged water | | Balance | Balance | Balance | Balance | Balance | Balance | Balance | Balance | Balance | Balance | Balance |
| | | Total | | 100 | 100 | 100 | 100 | 100 | 100 | 100 | 100 | 100 | 100 | 100 |
| | pH(25° C.) | | | 9.7 | 10.9 | 10.6 | 10.7 | 10.6 | 10.7 | 9.3 | 11.4 | 10.6 | 10.7 | 10.6 |
| Evaluation of detergency | | | Visual judgment | A | A | A | A | A | A | C | A | A | A | A |
| | | | Rating of protein stain | 3.6 | 4.6 | 3.8 | 4.4 | 4.6 | 4.4 | 1.8 | 4.8 | 2.2 | 4.4 | 4.6 |
| | | | Rating of fluorescent stain | 3 | 5 | 3 | 5 | 5 | 5 | 2 | 5 | 2 | 5 | 5 |
| Compatibility with a washer | | | | 4 | 4 | 4 | 3 | 4 | 4 | 4 | 4 | 4 | 1 | 4 |
| Mass change of alumite(mg) | | | | 0.7 | 6.5 | 1.4 | 1.2 | 4.2 | 0.9 | 0.5 | 15.8 | 1.7 | 1.6 | 11.7 |

(※)An amount of 0.025% by mass of the alkaline protease (12 (PU/g)) corresponds to 3 PU per kilogram of treatment liquid.

Table 3 shows results with treatment liquids with changed contents. Comparative Example 2-1 showed that a smaller content of the component (A) resulted in insufficient detergency. Comparative Example 2-2 showed that a larger content of the component (A) resulted in alumite corrosion. Comparative Example 2-3 showed that a smaller content of the component (B) resulted in insufficient detergency. Comparative Example 2-4 showed that a larger content of the component (B) resulted in inadequate foaming to reduce compatibility with a washer. Comparative Example 2-5 showed that a smaller content of the component (C) resulted in a large mass change of alumite and generation of alumite corrosion.

Example 3 and Comparative Example 3

Compositions for a treatment liquid shown in Table 4 were prepared and evaluated for storage stability of an enzyme therein according to the following method. These compositions were diluted with water at respective dilution rates shown in Table 4 to prepare treatment liquids. These liquids were evaluated in the same way as in Example 1. Results are shown in Table 4. In Example 3-2, compositions 3-2a and 3-2b were separately diluted and then mixed with each other to obtain the treatment liquid of Table 4. Also in Example 3-3, compositions 3-3a and 3-3b were separately diluted and then mixed with each other to obtain the treatment liquid of Table 4. Components in Table 4 were the same as those used in Example 1 etc. A pH was measured with a pH meter F-21 (Horiba Ltd.).

<Storage Stability of an Enzyme>

In each composition for a treatment liquid shown in Table 4, an enzyme activity was measured before and after storage for 2 weeks at 50° C. An enzyme activity after storage was compared with that before storage and a remaining activity was expressed as a percentage of the initial one. An enzyme activity was measured by the method for measuring a "proteolytic activity" described hereinabove, where the "enzyme solution" is replaced to "composition for a treatment liquid".

TABLE 4

| | | | Example | | | | | Comparative |
|---|---|---|---|---|---|---|---|---|
| | | | | 3-2 | | 3-3 | | example |
| | | | 3-1 | 3-2a | 3-2b | 3-3a | 3-3b | 3-1 |
| Composition for producing treatment liquid | Composition (mass %) | (A) Monoethanolamine | 10 | 12.5 | | 12.5 | | 10 |
| | | (B) Nonionic surfactant A | 5 | 6 | | 6 | | 5 |
| | | (C) Sorbitol | 15 | | 50 | 20 | | |
| | | Dipropylene glycol | 45 | | | | | |
| | | (D) Alkaline protease(※) | 5 | | 12.5 | | 25 | 5 |
| | | Trisodium citrate | | 20 | | | | |
| | | Sodium polyacrylate | | | | 5 | | |
| | | Sodium caprylate | | 6 | | | | |
| | | Ion-exchanged water | Balance | Balance | Balance | Balance | Balance | Balance |
| | | Total | 100 | 100 | 100 | 100 | 100 | 100 |
| | pH(25° C.) | | 11.6 | 12.1 | 7.2 | 11.8 | 7.2 | 11.6 |
| Storage stability [Enzyme activity(rate to initial value)] | | | 48% | — | 87% | — | 85% | 13% |
| Dilution rate | | | 200 times | 250 times | 500 times | 250 times | 1000 times | 200 times |
| Treatment liquid | Composition (mass %) | (A) Monoethanolamine | 0.05 | 0.05 | | 0.05 | | 0.05 |
| | | (B) Nonionic surfactant A | 0.025 | 0.024 | | 0.024 | | 0.025 |
| | | (C) Sorbitol | 0.075 | 0.075 | | 0.08 | | |
| | | Dipropylene glycol | 0.025 | | | | | |
| | | (D) Alkaline protease(※) | 0.025 | 0.025 | | 0.025 | | 0.025 |
| | | Trisodium citrate | | 0.08 | | | | |
| | | Sodium polyacrylate | | | | 0.02 | | |
| | | Sodium caprylate | | 0.024 | | | | |
| | | Water | Balance | Balance | | Balance | | Balance |
| | | Total | 100 | 100 | | 100 | | 100 |
| | pH(25° C.) | | 10.2 | 10.6 | | 10.4 | | 10.2 |
| Evaluation of detergency* | | Visual judgement | A | A | | A | | A |
| | | Rating of protein stain | 4.2 | 4.6 | | 4.4 | | 2.2 |
| | | Rating of fluorescent stain | 4 | 5 | | 5 | | 1 |
| Compatibility with a washer* | | | 4 | 4 | | 4 | | 4 |
| Mass change of alumite* (mg) | | | 1.5 | 2.3 | | 1.8 | | 10.5 |

*Any evaluation item was for a treatment liquid prepared with a thick composition for producing the treatment liquid after stored for 2 weeks at 50° C.

Examples showed good enzyme stability and a high cleaning performance, while Comparative Example 3-1 showed reduced enzyme activity and cleaning performance. Examples 3-2 and 3-3 using a two agent type showed especially a good enzyme stability and a high cleaning performance even after compositions were stored.

A mechanism of the action of the inventive method for cleaning is unknown, but assumed that: the monoethanolamine and the nonionic surfactant act on fixed dirt to make the dirt susceptible to the alkaline protease, and protein dirt decomposed and released is effectively dispersed by the nonionic surfactant.

The invention claimed is:

1. A method for cleaning a medical instrument, comprising treating a medical instrument with a treatment liquid, wherein the treatment liquid comprises:

(A) alkanolamine in an amount of 0.004 to 1% by mass, (B) a nonionic surfactant in an amount of 0.002 to 1% by mass, (C) a polyhydric alcohol in an amount of 0.004 to 10% by mass, (D) an alkaline protease in an effective amount, and (E) water;

the treatment liquid has a pH of not lower than 9; (A) the alkanolamine is monoethanolamine and a mass ratio of the alkanolamine component (A) to the polyhydric alcohol component (C), (A)/(C), is 2/1 to 1/50;

wherein the component (B) is a polyoxyalkylene ether represented by the following formula (1-1-1):

$$RO\text{-}[(EO)_l/(PO)_m]\text{—}H \quad (1\text{-}1\text{-}1)$$

wherein R represents a hydrocarbon group with 6 to 18 carbon atoms; EO represents an ethanediyloxy group; PO represents a propanediyloxy group; l and m independently represent a number of 1 to 20; and "/" represents a symbol meaning that EOs and POs may be arranged at random or in block in any order.

2. The method for cleaning a medical instrument according to claim 1, wherein the treatment liquid is prepared by diluting one, two or more composition for producing the treatment liquid in water at a dilution rate of 50 to 5000 times.

3. The method for cleaning a medical instrument according to claim 1, wherein the treatment liquid is prepared from a composition for producing the treatment liquid comprising at least the polyhydric alcohol (C) and the alkaline protease (D) and at least one composition for producing a treatment liquid other than the composition for producing the treatment liquid comprising at least the polyhydric alcohol (C) and the alkaline protease (D).

4. The method for cleaning a medical instrument according to claim 1, wherein the treatment liquid is prepared immediately before contacting the treatment liquid with the medical instrument.

5. The method for cleaning a medical instrument according to claim 1, wherein the nonionic surfactant (B) in the treatment liquid is a nonionic surfactant represented by the formula (1-1-3'):

$$RO\text{-}[(EO)_l\backslash(PO)_m]\text{—}H \qquad (1\text{-}1\text{-}3')$$

wherein, R represents a branched alkyl group with 7 to 10 carbon atoms; EO represents an ethanediyloxy group; PO represents a propanediyloxy group; l and m represent average mole numbers of EO's and PO's added, respectively, ranging from 3 to 10; and "\" represents a symbol meaning that EO's and PO's are arranged at random.

6. The method for cleaning a medical instrument according to claim 1, wherein a mass ratio of components (A) to (C) in the treatment liquid, (A)/(C), is 1/1 to 1/50.

7. The method for cleaning a medical instrument according to claim 1, wherein the polyhydric alcohol (C) in the treatment liquid comprises at least a compound (C1) having 4 to 10 hydroxy groups in a molecule.

8. The method for cleaning a medical instrument according to claim 1, wherein the polyhydric alcohol (C) in the treatment liquid comprises at least a compound (C1) having 4 to 10 hydroxy groups in a molecule and at least one polyhydric alcohol (C2) other than the compound (C1).

9. The method for cleaning a medical instrument according to claim 1, wherein the treatment liquid further comprises a sequestering agent in an amount of 0.002 to 0.5% by mass.

10. The method for cleaning a medical instrument according to claim 1, wherein the content of the component (A) in the treatment liquid is 0.008 to 0.2% by mass.

11. The method for cleaning a medical instrument according to claim 1, wherein the content of the component (B) in the treatment liquid is 0.005 to 0.5% by mass.

12. The method for cleaning a medical instrument according to claim 1, wherein the content of the component (C) in the treatment liquid is 0.02 to 0.5% by mass.

13. The method for cleaning a medical instrument according to claim 1, wherein a pH of the treatment liquid is 10 to 12.

14. The method for cleaning a medical instrument according to claim 1, wherein a mass ratio of components (A) to (C), (A)/(C), is 1/1 to 1/20.

15. The method for cleaning a medical instrument according to claim 1, wherein a mass ratio of components (A) to (C), (A)/(C), is 2/3 to 1/10.

* * * * *